United States Patent [19]

Watkins et al.

[11] 3,981,358

[45] Sept. 21, 1976

[54] WELL SAFETY VALVE

[75] Inventors: Fred E. Watkins, Houston, Tex.; James R. Reaux, New Orleans, La.

[73] Assignee: Camco, Incorporated, Houston, Tex.

[22] Filed: Nov. 14, 1975

[21] Appl. No.: 632,032

[52] U.S. Cl. ..... 166/224 A; 251/79

[51] Int. Cl.[2] ..... E21B 43/12

[58] Field of Search ..... 166/224 A; 137/460, 137/495, 498, 629

[56] References Cited

UNITED STATES PATENTS

| | | | |
|---|---|---|---|
| 3,749,119 | 7/1973 | Tausch et al. | 166/224 A |
| 3,786,866 | 1/1974 | Tausch et al. | 166/224 A |
| 3,865,141 | 2/1975 | Young | 166/224 A |

*Primary Examiner*—James A. Leppink
*Attorney, Agent, or Firm*—Fulbright & Jaworski

[57] ABSTRACT

In a well safety valve for controlling the fluid flow through a well tubing in which the valve closure means is controlled by a longitudinal movable tubular member, the improvement of a fail-safe mechanism for avoiding damage to the valve by avoiding excessive operating forces. The tubular member includes first and second telescoping sections which are releasably locked together in an intermediate extended position for normally opening and closing the valve on movement of the tubular member. The releasable locking means is sized to release upon the application of a predetermined force less than a force sufficient to cause damage to the valve whereby upon application of an excessive force the sections will telescope towards each other preventing damage to the valve. Tool engaging means are provided on the second telescoping section for repositioning the tubular sections relative to each other or for extending the second section for locking the valve closure member in the open position. A third section may be provided telescopically engaging the first section and positioned axially aligned above the second section in which one-way clutch means is provided between the first and third sections allowing downward movement of the third section relative to the first section with tool engaging means on the third section for moving the third section downwardly for engaging the second section and locking the second section in an extended lockout position.

7 Claims, 6 Drawing Figures

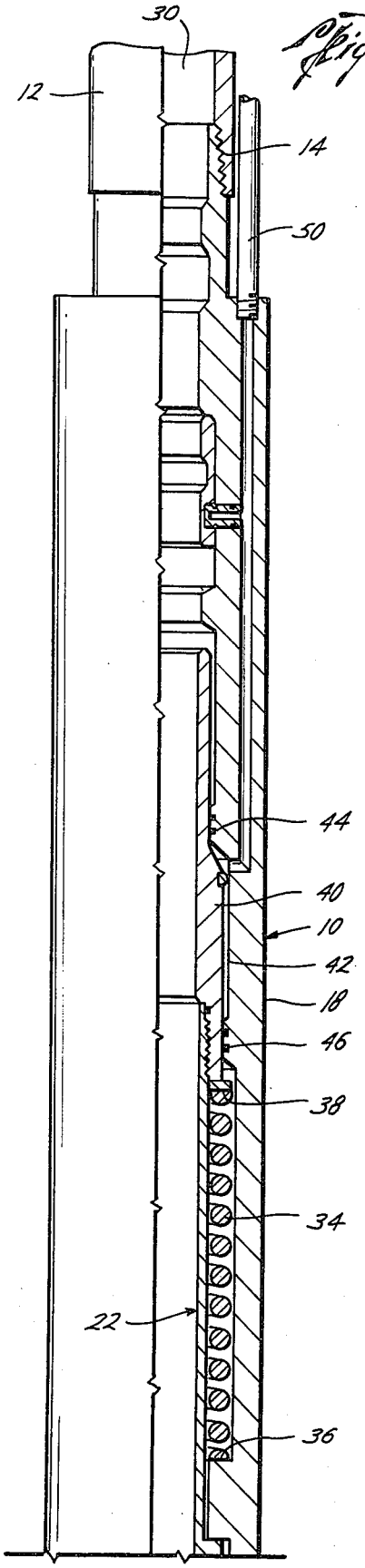
Fig. 1A
Fig. 1B
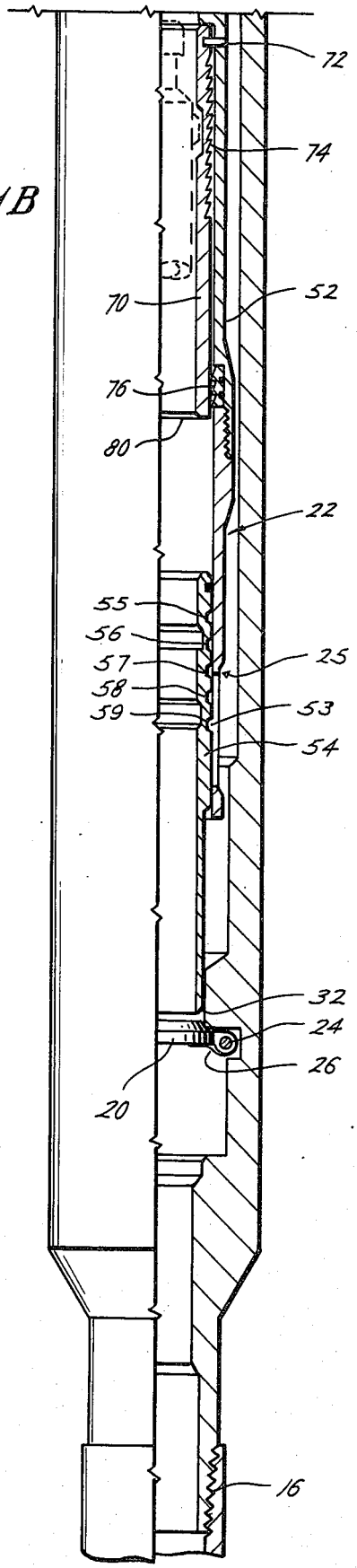

WELL SAFETY VALVE

BACKGROUND OF THE INVENTION

Generally, it is old to provide a well safety valve for controlling the fluid flow through a well tubing, such as shown in U.S. Pat. No. 3,786,866, in which the valve is adapted to be positioned in the well tubing and a longitudinal movable tubular member controls the movement of the valve closure member. Generally, a tubular member is actuated by hydraulic pressure for moving the valve closure member between a closed and open position.

However, in the past, excessive hydraulic pressure has been applied to the well safety valve, generally during the opening operation, causing damage to some component of the valve such as the tubular member or the valve closure member.

The present invention is directed to an improved subsurface safety valve which is provided with a fail-safe mechanism which is actuated to release upon the application of a predetermined force less than a force sufficient to cause damage to the valve. The mechanism is reactivable and also allows the valve to be used as a lockout for locking the valve closure member in the open position. The valve may also incorporate a permanent lockout section whereby the valve will then provide either a temporary or a permanent lockout mode of operation.

SUMMARY

The present invention is generally directed to providing a well safety valve which includes a fail-safe releasing mechanism for avoiding damage to the valve in the event that it is actuated by excessive forces.

The present invention is further directed to various improvements in a well safety valve which controls the fluid flow through a well tubing and includes a longitudinally movable tubular member controlling the movement of a valve closure member in which first means is provided for moving the tubular member in a first direction, and second means are provided for moving the tubular member in a second direction in which the tubular member includes a first and second telescoping section. Releasable locking means normally secure the telescoping sections together, but is adapted to release upon the application of a predetermined force less than a force sufficient to cause damage to the valve. The first and second telescoping sections are normally secured in an intermediate extended position for normal operation but upon the application of a predetermined force to the tubular member will allow the first and second sections to telescope towards each other thereby avoiding damage to the valve.

A still further object is the provision of tool engaging means on the second telescoping section for moving the second section for resetting the first and second sections relative to each other and/or moving the second section downwardly for providing a lockout of the valve closure member for locking the valve in the open position.

Still a further object of the present invention is the provision of spring collet means for providing a releasable and re-engaging locking means whereby the first and second telescoping sections may function as a valve lockout as well as a reactivatable fail-safe mechanism.

A further object of the present invention is the provision of a third section telescopically engaging the first section and positioned axially aligned with and above the second section in which one-way clutch means are provided between the first and third sections allowing downward movement of the third section relative to the first section. Tool engaging means are provided on the third section for moving the third section downwardly for engaging the second section and locking the second section in an extended position for permanently locking the valve in the open position.

Other and further objects, features and advantages will be apparent from the following description of a presently preferred embodiment of the invention, given for the purpose of disclosure and taken in conjunction with the accompanying drawings.

BRIEF DESCRIPTION OF THE DRAWINGS

FIG. 1A is an elevational view, partly in cross section, of the top portion of a safety valve in which the valve is positioned in the closed position, FIG. 1B is a continuation of FIG. 1A.

DESCRIPTION OF THE PREFERRED EMBODIMENT

For the purpose of illustration only, the present invention will be described in connection with a tubing retrievable flapper type safety valve. However, it is to be recognized that the present apparatus may be used with other types of safety valves such as retrievable safety valves, and with safety valves including those having different valve closure means.

Figure 2A:
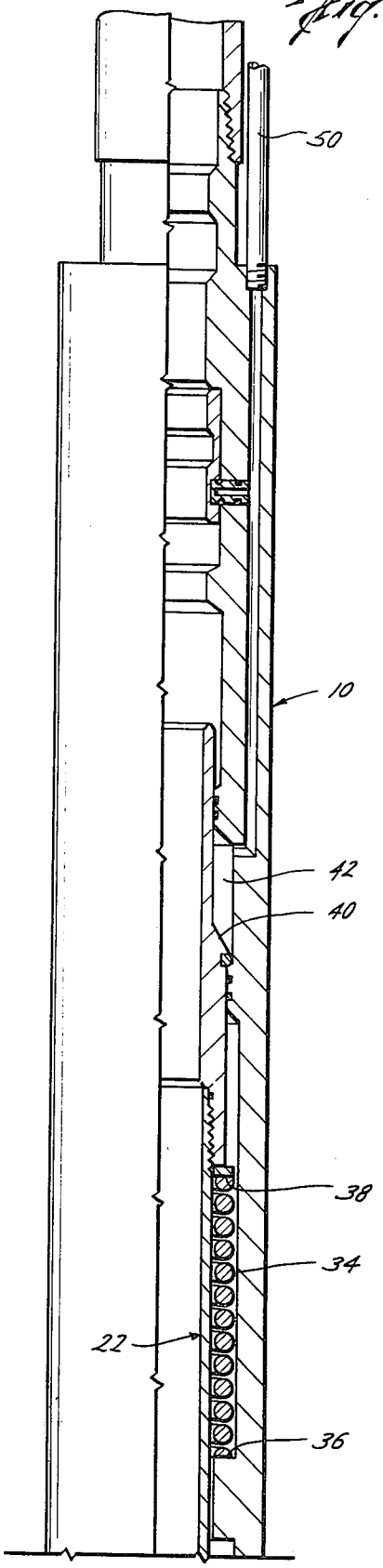
FIG. 2A is an elevational view, partly in cross section, of the top portion of the safety valve of FIGS. 1A and 1B, but in the open position.
Figure 2B:
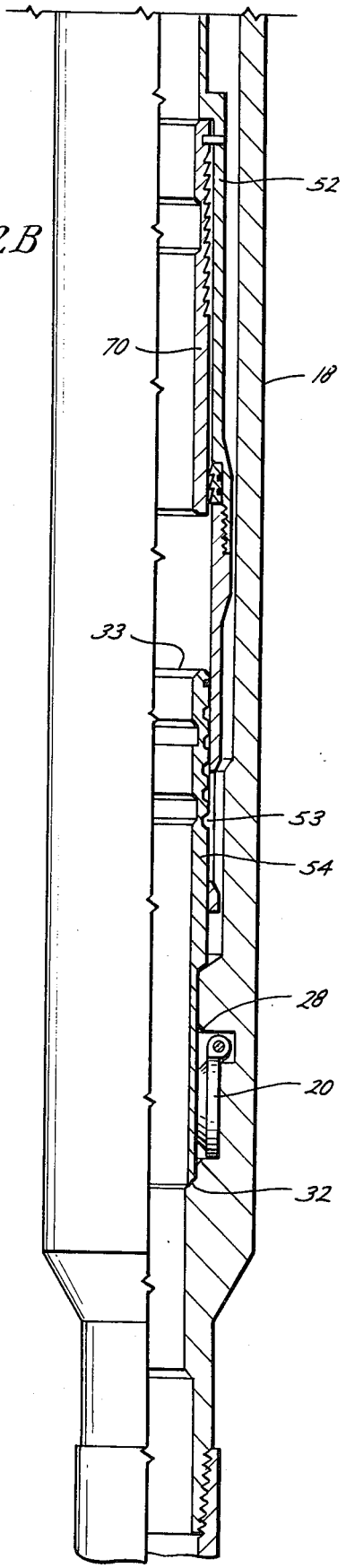
FIG. 2B is a continuation of FIG. 2A.

Referring now to the drawings, and particularly to FIGS. 1A, 1B, 2A and 2B, the reference numeral 10 generally indicates a well safety valve of the tubing retrievable type adapted to form a portion of a well tubing 12 by being connected therein by suitable threaded connections 14 (FIG. 1A) at the top and suitable threaded connections 16 (FIG. 1B) at the bottom. The safety valve 10 is provided to control the fluid flow through the bore 30 of the well tubing 12 and the safety valve 10. Under normal flow conditions, the safety valve 10 is in the open position, as best seen in FIGS. 2A and 2B. The valve 10 is moved to a closed position, as best seen in FIGS. 1A and 1B, in the event of equipment failure or other undesirable conditions to shut off well production through the bore 30.

The safety valve 10 generally includes a valve body 18, a valve closure member, such as a flapper valve 20, a longitudinal movable operating member generally indicated by the reference numeral 22 for controlling the movement of the flapper valve 20. The flapper valve 20 is carried about a pivot 24 and may include a spring 26 for yieldably urging the flapper valve 20 about the pivot 24 and onto an annular valve seat 28 for closing the valve 10 and blocking upward flow of fluid through the bore 30 of the valve 10 and tubing 12.

The tubular member 22 is longitudinally movable in the valve body 18. When the lower end 32 of the member 22 is moved downwardly and contacts the flapper 20, the flapper 20 is moved off of the valve seat 28 and into a downward and open position, as best seen in FIG. 2B, thereby permitting fluid flow through the bore 30. However, when the tubular member 22 is moved upwardly and its lower end 32 is moved above the valve seat 28, the spring 26 and/or fluid flow upwardly through the valve 10 closes the flapper 20.

Any suitable control means for controlling the movement of the tubular member 22 may be used. For example, a biasing spring 34 (FIGS. 1A and 2B) may be positioned between a shoulder 36 on the valve body 18 and a shoulder 38 on the tubular member 22 for biasing the tubular member 22 upwardly and in a direction allowing the flapper 20 to close. In order to provide means for moving the tubular member 22 in a downward direction, a piston 40 may be provided on the tubular member 22 for movement in a cylinder 42 formed by seals 44 and 46. A control line 50 may be provided leading to the well surface for supplying a fluid therein which communicates with the cylinder 42 for controlling the movement of the piston 40 and thus of the tubular member 22. If fluid pressure is applied through the line 50 and into the cylinder 42, the piston 40 and the tubular member 22 are moved downwardly overcoming the spring 34 and opening the flapper 20. The flapper 20 is closed by reducing the fluid pressure in the control line 50 and in the chamber 42 allowing the spring 34 to move the tubular member 22 upwardly releasing the flapper valve 20. The above operation of the safety valve is generally conventional.

However, problems have been encountered in the past in the use of safety valves, such as when the pressure beneath the flapper 20 is high and when excessive hydraulic pressure was applied through the control line 50 to open the valve 10, causing damage to some component of the valve, such as the tubular member 22 or the flapper 20. The present invention is directed to a mechanism which will protect the valve from the results of applying excessive actuating pressure to the valve 10.

As best seen in FIGS. 1B and 2B, the tubular member 22 includes a first upper section 52 and a second lower section 54 which are telescopically positioned relative to each other. The first and second tubular sections 52 and 54 are normally secured together by a suitable releasable and re-engageable locking means 25. One suitable form of locking means is a spring collet connected to the first section 52 including a shoulder or lug 53 having beveled edges at the top and bottom and a plurality of lug receiving notches 55, 56, 57, 58, and 59 on the second section 54. The releasing locking means 25 which extends longitudinally between the first section 52 and the second section 54 normally secures the first section 52 and second section 54 together at a position shown in FIGS. 1B and 2B in an intermediate extended position with lug 53 being positioned in releasable notch 59 at a position for opening and closing the valve closure member 20 on movement of the tubular member 22. Therefore, under normal conditions, the tubular member 22 which includes first section 52 and second section 54 operates as a unit, as best seen in FIGS. 1A, 1B, 2A and 2B to open and close the valve closure member 20.

Figure 3:
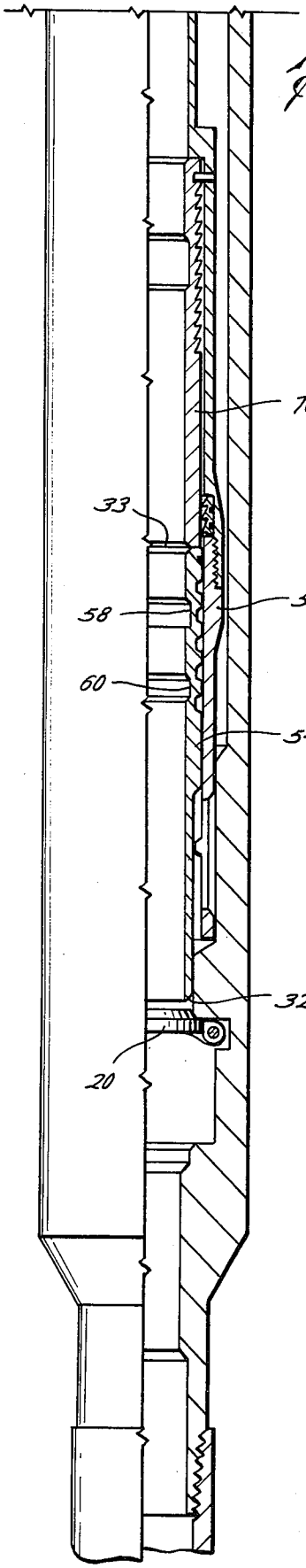
FIG. 3 is a fragmentary elevational view, partly in cross section, of the lower portion of the safety valve of FIGS. 1A, 1B, 2A and 2B, in which the tubular member is shown in the collapsed position.

However, to protect the valve 10 from the effects of over-pressuring and to serve as an indication that excessive pressure has been applied, the releasable locking means 25 is designed and sized to collapse upon the application of a predetermined force less than a force which would cause damage to the valve. The application of the predetermined force will cause the sections 52 and 54 to telescope towards each other, as best seen in FIG. 3, upon the application of an excessive fluid pressure in the fluid line 50. As best seen in FIG. 1B and 2B, the releasable locking means normally secures the telescoping sections 52 and 54 in an intermediate extended position so that when the bottom end 32 of the telescoping sections 54 engages the top of the flapper 20 upon the application of excessive pressure, the top end 33 of the second section 54 may move upwardly relative to the first section 52. That is, upon opening the valve 10 by applying fluid pressure to the line 50, if the pressure in the bore 30 below the flapper 20 is not sufficient to cause the lug 53 to move out of the notch 59 before the flapper 20 is moved off of the seat 28, the forces will be insufficient to cause damage to the valve. However, with the flapper 20 closed and with significant pressure below the flapper 20, the lower end 32 of the second section 54 will contact the flapper 20 when hydraulic pressure is applied. An increase in hydraulic pressure in the line 50 beyond a predetermined amount will cause the lug 53 to move out of the notch 59 to release and allow normal downward movement of the section 52 without further loading of the flapper 20 or the end 32 of the second section 54.

However, if the lower section 54 collapses and telescopes upwardly relative to section 52, as best seen in FIG. 3, the safety valve 10 becomes inoperative and is unable to open the flapper 20 and the well cannot be produced. The valve 10 can, however, be placed back into the normal operating position, as shown in FIGS. 1A, 1B, 2A and 2B, by shifting or extending the lower collapsed section 54 downwardly. The inside of the second telescoping section 54 includes a suitable tool engaging means such as one or more recesses 58 and 60 for suitable engagement by any conventional actuating tool such as a Z-lock manufactured by Camco, Incorporated, or actuating tools such as disclosed in U.S. Pat. No. 3,786,866. One procedure would be to apply fluid pressure in the bore 30 to overcome the excesive pressure on the downstream side of the flapper 20, or otherwise relieve the pressure below the flapper 20, and lower a suitable actuating tool on a wireline into engagement with one or both of the recesses 58 and 60 and jar downwardly thereby extending the lower section 54 to its normal operating position as best seen in FIG. 2B.

It is noted that the releasable and re-engaging locking means 25, such as the spring collet, allows the lug 53 on section 52 to be positioned in one of a plurality of notches 55, 56, 57, 58 or 59 on the section 54 thereby allowing the longitudinal positioning of section 54 relative to section 52 in various positions. Therefore, an alternate means for reactivating the safety valve 10, after the section 54 has been collapsed, can be performed by relieving the pressure below the flapper 20, and extending the collapsed section 54 by suitable tool engaging means engaging one or both of the recesses 58 and 60 before applying pressure through the conduit 50. The latter procedure will move the section 54 downwardly relative to the section 52 to place the lug 53 in notch 55 thereby locking the valve 10 in the open position. After this, pressure may be applied through the conduit 50 to move the upper section 52 downwardly thereby moving the lug 53 out of the notch 55 and into the notch 59, as best seen in FIG. 1B, in the normal engaged operating position.

It is to be noted that the releasable re-engaging locking means allows the lower section 54 to act not only as a fail-safe mechanism but also as a lockout which can be extended downwardly to lock the flapper valve 20 in the open position thereby allowing temporary, unrestricted passage of wireline tools. Therefore, another feature of the present valve 10 is to provide a valve that can be temporarily locked out and reactivated to a normal operating position.

Figure 4:
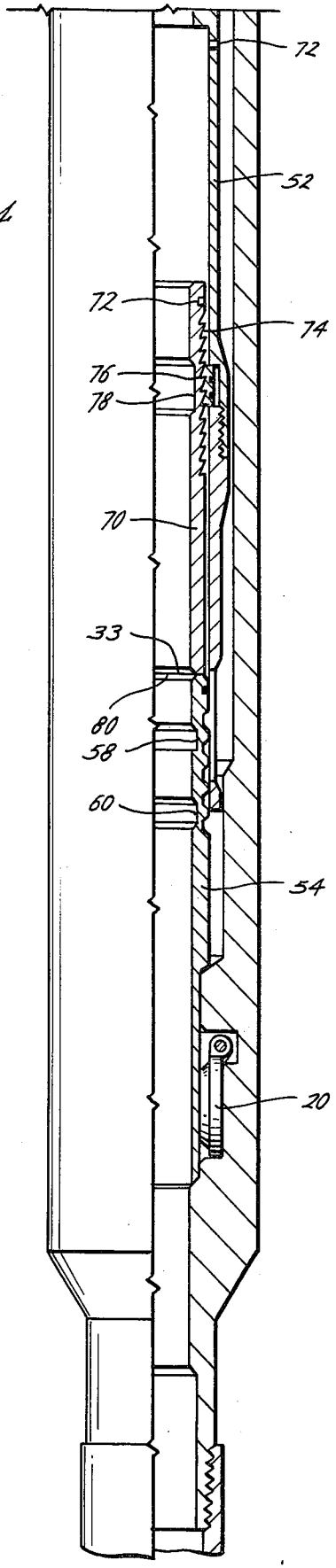
FIG. 4 is a fragmentary elevational view, partly in cross section, of the lower portion of the safety valve of the present invention showing the actuation of the tubular member into a lockout position for permanently holding the valve in the open position.

Another feature of the present invention is the provision of a mechanism that allows the valve 10 to be permanently locked in the open position for the reasons stated in U.S. Pat. No. 3,786,866. Thus, a third tubular member 70 is provided telescopically engaging the inside of the first section 52 and positioned axially aligned with and spaced above the second section 54. Preferably, the third section 70 is releasably secured to the first section 52 by any suitable means such as a shear pin 72. In addition, one-way clutch means, which may consist of buttress type threads 74 on the third member 70 and opposing buttress threads 76 on the first section 52, is provided between the first section 52 and third section 70 allowing downward movement of the third section 70 relative to the first section 52. The inside of the third section 70 includes a suitable tool engaging recess such as recess 78 for suitable engagement by any conventional actuating tool for moving the third section 70 downwardly. Downward movement of the third section 70 will shear pin 72, and as best seen in FIG. 4 will move the lower end 80 of the third section 70 downwardly into engagement with the upper end 33 of the second section 54 driving the second section 54 downwardly to open and lock out flapper valve 20. The engagement of the threads 74 on section 70 with teeth 76 on section 52 will secure the downward movement of section 70 and section 54 in the locked out position.

Therefore, the present safety valve 10 in addition to providing a fail-safe mechanism which prevents damage to the valve as best seen in FIG. 3, can also be used as either a temporary or a permanent lockout. As seen in FIG. 4, the second section 54 may be moved downwardly independently to a locked out position by a suitable tool engaging one or both of the recesses 58 and 60 on the member 54. Or the valve 10 may be placed in a permanent locked out position by actuation of the third section 70 by a suitable actuating tool engaging recess 78.

The present invention, therefore, it well adapted to carry out the objects and attain the ends and advantages mentioned as well as others inherent therein. While a presently preferred embodiment of the invention has been given for the purpose of disclosure, numerous changes in the details of construction and arrangement of parts, may be provided, without departing from the spirit of the invention and the scope of the appended claims.

What is claimed is:

1. In a well safety valve for controlling the fluid flow through a well tubing, the valve adapted to be positioned in the well tubing and having a valve closure member moving between open and closed positions, a longitudinally movable tubular member for controlling the movement of the valve closure member, first means for moving the tubular member in a first direction, second means for moving the tubular member in a second direction, the improvement comprising, said tubular member including a first upper and a second lower telescoping section, releasable locking means normally securing the telescoping sections together, and releasable means constructed to release upon the application of a predetermined force less than a force sufficient to cause damage to the valve, said releasable locking means normally securing the telescoping sections in an intermediate extended position whereby upon the application of said predetermined force, said sections will telescope towards each other preventing damage to said valve, and tool engaging means on the second telescoping section for extending said section downwardly for opening the valve closure member.

2. The apparatus of claim 1 including, a third section telescopically engaging the first section and positioned axially aligned above the second section, one-way clutch means between the first and third sections allowing downward movement of the third section relative to the first section, and tool engaging means on the third section for moving said third section downwardly for engaging the second section and locking the second section in an extended position.

3. The apparatus of claim 1 wherein the releasable engaging means includes a spring collet.

4. In a well safety valve for controlling the fluid flow through a well tubing, the valve adapted to be positioned in the well tubing and having a valve closure member moving between open and closed positions, a longitudinally movable tubular member for controlling the movement of the valve closure member, first means for moving the tubular member in a first direction, second means for moving the tubular member in a second direction, the improvement comprising, said tubular member including a first upper and a second lower telescoping section, releasable locking means normally securing the telescoping first and second sections together for opening and closing said valve closure member on movement of the tubular member, tool engaging means on the second telescoping section for extending said second section downwardly for opening the valve closure member, a third second telescopically engaging the first section and positioned axially aligned above the second section, one-way clutch means between the first and third sections allowing downward movement of the third section relative to the first section, and tool engaging means on the third section for moving said third section downwardly for engaging the second section and locking the second section in an extended position.

5. In a well safety valve for controlling the fluid flow through a well tubing, the valve adapted to be positioned in the well tubing and having a valve closure member moving between open and closed positions, a longitudinally movable tubular member for controlling the movement of the valve closure member, first means for moving the tubular member in a first direction, second means for moving the tubular member in a second direction, the improvement comprising, said tubular member including a first upper and a second lower telescoping section with the second section positioned inside the first section, releasable locking means extending longitudinally between said first and second members for securing the first and second members together in various telescoping positions, said locking means normally securing the first and second sections together at a position for opening and closing said valve closure member on movement of the tubular member, said releasable locking means sized to release upon the application of a predetermined force less than a force sufficient to cause damage to the valve, said releasable locking means normally securing the telescoping sections in an intermediate extended position whereby upon the application of said predetermined force said sections will telescope towards each other preventing damage to said valve, and tool engaging means on the second telescoping section for extending said second section downwardly.

6. The apparatus of claim 5 including, a third section telescoping engaging the first section and positioned axially aligned above the second section, one-way clutch means between the first and third sections allowing downward movement of the third section relative to the first section, and tool engaging means on the third section for moving said third section downwardly for engaging the second section and locking the second section in an extended position.

7. The apparatus of claim 5 wherein the releasable engaging means includes a spring collet.

* * * * *

UNITED STATES PATENT OFFICE

CERTIFICATE OF CORRECTION

PATENT NO. : 3,981,358

DATED : September 21, 1976

INVENTOR(S) : Fred E. Watkins and James R. Reaux

It is certified that error appears in the above-identified patent and that said Letters Patent are hereby corrected as shown below:

Column 4, line 47, cancel "excesive" and insert -- excessive --

Column 5, line 55, cancel "it" and insert -- is --

Column 6, line 9, delete "and" and insert -- said --

Column 6, line 53, delete "second" and insert --section --

Column 8, line 7, cancel "telescoping" and insert -- telescopically --

Signed and Sealed this

Fourth Day of January 1977

[SEAL]

*Attest:*

RUTH C. MASON
*Attesting Officer*

C. MARSHALL DANN
*Commissioner of Patents and Trademarks*